US009383118B2

(12) United States Patent
Wang

(10) Patent No.: US 9,383,118 B2
(45) Date of Patent: Jul. 5, 2016

(54) HEAT EXCHANGER FOR AN INDOOR UNIT OF AN AIR CONDITIONER

(75) Inventor: Xiongcheng Wang, Zhongshan (CN)

(73) Assignee: ZHONGSHAN BROAD-OCEAN MOTOR MANUFACTURING CO., LTD., Zhongshan (CN)

( * ) Notice: Subject to any disclaimer, the term of this patent is extended or adjusted under 35 U.S.C. 154(b) by 959 days.

(21) Appl. No.: 12/876,148

(22) Filed: Sep. 5, 2010

(65) Prior Publication Data

US 2011/0240262 A1 Oct. 6, 2011

(30) Foreign Application Priority Data

Mar. 30, 2010 (CN) ..... 2010 2 0152174 U

(51) Int. Cl.
*F24F 13/20* (2006.01)
*F24F 1/00* (2011.01)

(52) U.S. Cl.
CPC ..... *F24F 13/20* (2013.01); *F24F 1/0022* (2013.01)

(58) Field of Classification Search
CPC ..... F04D 29/22; F04D 29/626; F04D 17/162; F24F 1/0022
USPC ..... 165/122, 145, 146; 415/203–206; 248/674–675; 417/360, 353; 62/516, 62/507, 515, 411
See application file for complete search history.

(56) References Cited

U.S. PATENT DOCUMENTS

| | | | | | |
|---|---|---|---|---|---|
| 2,615,620 | A * | 10/1952 | Goettl | 416/244 R |
| 2,776,088 | A * | 1/1957 | Wentling | 417/354 |
| 2,936,947 | A * | 5/1960 | Staak | 417/353 |
| 3,774,680 | A * | 11/1973 | Andreoli | 165/122 |
| 3,800,866 | A * | 4/1974 | Ireland et al. | 165/122 |
| 3,827,483 | A * | 8/1974 | Hopkinson | 165/145 |
| 4,200,257 | A * | 4/1980 | Litch, III | 248/604 |
| 4,597,555 | A * | 7/1986 | Weihsmann | 248/672 |
| 5,211,219 | A * | 5/1993 | Kawabata et al. | 165/122 |
| 7,263,850 | B2 * | 9/2007 | Eom et al. | 62/286 |

* cited by examiner

*Primary Examiner* — Tho V Duong
(74) *Attorney, Agent, or Firm* — Matthias Scholl P.C.; Matthias Scholl

(57) ABSTRACT

A heat exchanger for an indoor unit of an air conditioner, including at least a housing (1) having an air inlet (15) and an air outlet (16), a cooling coil (3), and a centrifugal blower (4) having an air exit (17), a volute housing (5), a motor (6) and a centrifugal wind wheel (7). The cooling coil (3) and the centrifugal blower (4) are disposed in the housing (1). The air inlet (15) and the air outlet (16) are disposed on both ends of the housing (1). The cooling coil (3) is disposed at the back of the air inlet (15). The centrifugal blower (4) is disposed at the back of the cooling coil (3). The air exit (17) of the centrifugal blower (4) is connected to the air outlet (16) of the housing (1). The motor (6) is an external rotor motor and fits in the center of a cavity in the centrifugal wind wheel (7). A left air intake (11) and a right air intake (12) are formed on both sides of the volute housing (5). The heat exchanger features large air input and air output, and high blowing efficiency.

4 Claims, 7 Drawing Sheets

HEAT EXCHANGER FOR AN INDOOR UNIT OF AN AIR CONDITIONER

CROSS-REFERENCE TO RELATED APPLICATIONS

Pursuant to 35 U.S.C. §119 and the Paris Convention Treaty, this application claims the benefit of Chinese Patent Application No. 201020152174.7 filed on Mar. 30, 2010, the contents of which are incorporated herein by reference.

BACKGROUND OF THE INVENTION

1. Field of the Invention

The invention relates to a heat exchanger for an indoor unit of an air conditioner.

2. Description of the Related Art

Most heat exchanger systems for indoor units for air conditioners in the market each comprise a housing, an air filter, cooling coils, and a centrifugal blower. The centrifugal blower comprises a volute housing, a motor, a centrifugal wind wheel, a motor bracket and a housing bracket. The housing bracket is connected to and supports the volute housing. The motor is connected to the centrifugal wind wheel and disposed in the volute housing. As shown in FIG. 1, a pair of air intakes 2 is disposed on both sides of the volute housing 1. A motor 3 is disposed at one air intake on one side and the other air inlet is impending.

Problems with the structure include the following: the motor 3 is disposed on the air intake on one side, which blocks the air intake 2 to some extent and increases overall wind resistance; in addition, one end of a rotating shaft of the motor 3 is connected to the center of the centrifugal wind wheel 4 and thus driving the centrifugal wind wheel 4 to rotate, and the centrifugal wind wheel 4 mainly inhales airflow from the other air intake on the other side, which causes small air input, non-uniform intake on both sides, and high probability of resonance, and thus severely affecting air-intake and resulting in low blowing efficiency of the heat exchanger for the indoor unit of the overall air conditioner.

SUMMARY OF THE INVENTION

In view of the above-described problem, it is one objective of the invention to provide a heat exchanger for an indoor unit of an air conditioner that is capable of addressing the above-mentioned problems, and features laminar and balanced air-intake, large air output, high blowing efficiency, small vibration noise, and low cost.

To achieve the above objectives, in accordance with one embodiment of the invention, provided is a heat exchanger for an indoor unit of an air conditioner, comprising a housing having an air inlet and an air outlet, a cooling coil, and a centrifugal blower having an air exit, a volute housing, a motor and a centrifugal wind wheel.

The cooling coil and the centrifugal blower are disposed in the housing. The air inlet and the air outlet are disposed on both ends of the housing. The cooling coil(s) is/are disposed at the back of the air inlet. The centrifugal blower is disposed at the back of the cooling coil. The air exit of the centrifugal blower is connected to the air outlet of the housing. The motor is an external rotor motor and fits in the center of a cavity in the centrifugal wind wheel. A left air intake and a right air intake are formed on both sides of the volute housing.

In a class of this embodiment, the motor comprises a rotating shaft and a bracket.

In a class of this embodiment, both ends of the rotating shaft are disposed on the bracket, and the bracket is disposed at the left air intake and the right air intake of the volute housing.

In a class of this embodiment, a flange is disposed at the left air intake and the right air intake, and on the volute housing. One end of the bracket is connected to the flange, and the other end thereof is connected to an end of the rotating shaft of the motor whereby hanging the motor and the centrifugal wind wheel in a cavity of the volute housing.

In a class of this embodiment, the bracket comprises a connecting part, a receiving part, and a supporting part, and the supporting part operates to connect the connecting part to the receiving part.

In a class of this embodiment, a shaft sleeve is disposed on outer wall of the end of the rotating shaft, and the connecting part is directly welded on the shaft sleeve.

In a class of this embodiment, the flange, the receiving part of the bracket, and the volute housing are fit with each other via bolts.

In a class of this embodiment, the supporting part of the bracket is in the shape of a distorted sheet.

In a class of this embodiment, an air filter is disposed at the air inlet.

In a class of this embodiment, the cooling coil is V-shaped.

Advantages of the invention include the following:

1) structure of the heat exchanger for the indoor unit of the air conditioner is reasonable, the left air intake and the right air intake are disposed on both sides of the volute housing of the centrifugal blower, and the motor and the centrifugal wind wheel are hang in the volute housing via the bracket, and thus the left air intake and the right air intake are not blocked, and overall wind resistance is small; the centrifugal wind wheel inhales airflow from the left air intake and the right air intake simultaneously, which ensures fluent and balanced air-intake from both sides thereof, increased air input and air output, small probability of resonance, and high blowing efficiency of the heat exchanger for the indoor unit of the air conditioner;
2) supporting part on the bracket is in the shape of a distorted sheet, which increases toughness and joint strength of the supporting part, and improves structural strength of the bracket without increasing thickness of the bracket or adding a reinforcing rib, reduces consumables of the bracket and structural cost; and
3) the motor is an external rotor motor and fit in the center of the cavity in the centrifugal wind wheel, and the motor is supported by both ends of an output shaft, which ensure a large output torque of the motor, small vibration and noise, and stable operation.

DETAILED DESCRIPTION OF THE EMBODIMENTS

Further description of the invention will be given below in conjunction with specific embodiments and accompanying drawings.

Figure 1:
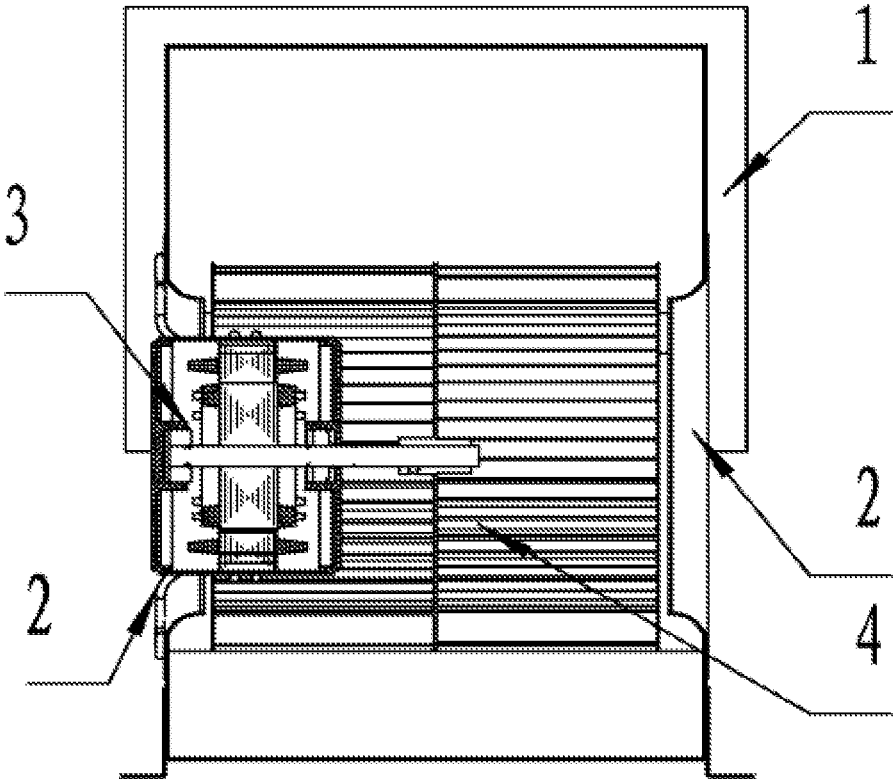
Prior Art FIG.1
FIG. 1 is a schematic view of a heat exchanger for an indoor unit of an air conditioner in the related art.
Figure 2:
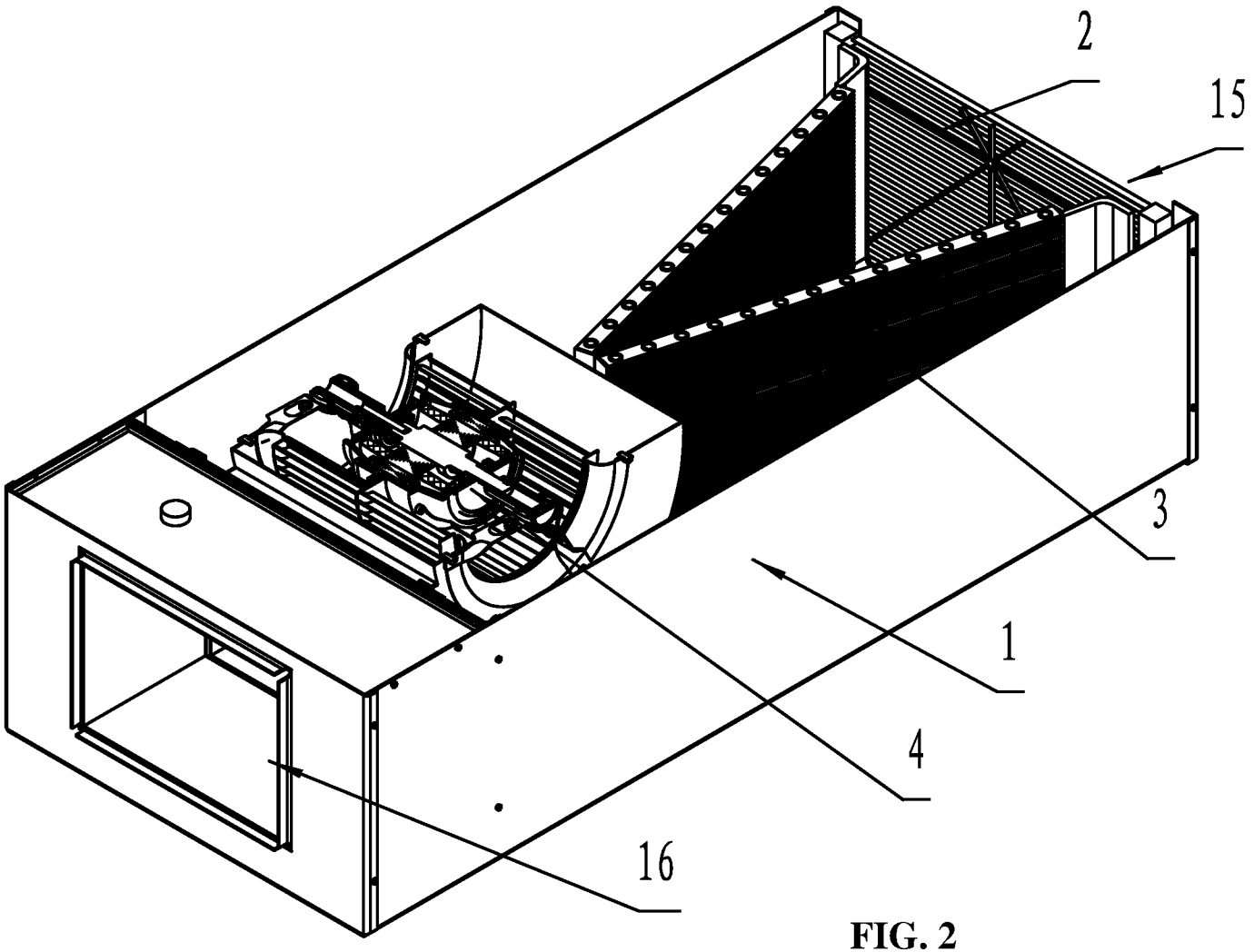
FIG. 2 is a cross-sectional view of a heat exchanger for an indoor unit of an air conditioner of the invention.
Figure 3:
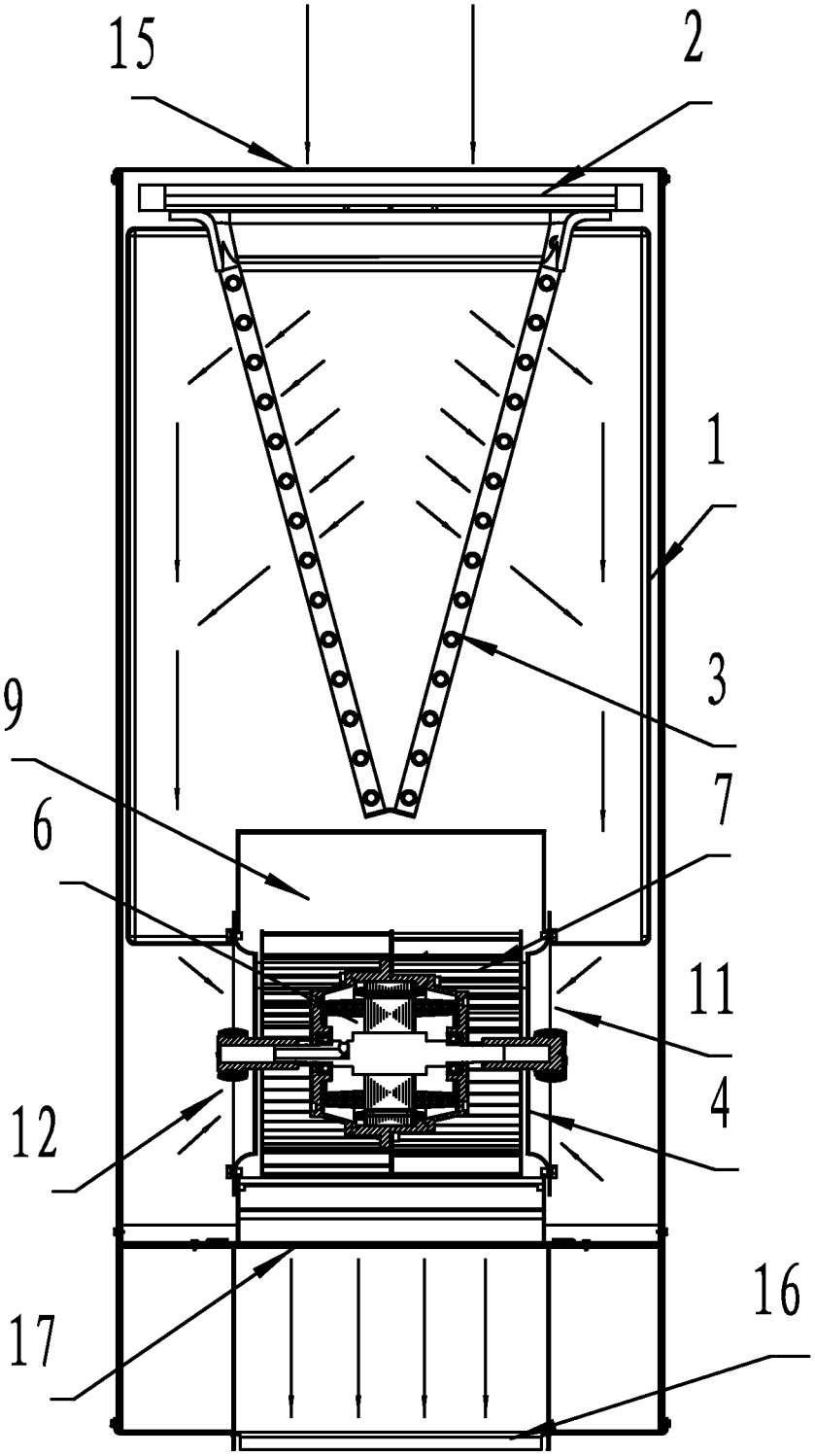
FIG. 3 is a schematic view of FIG. 2.
Figure 4:
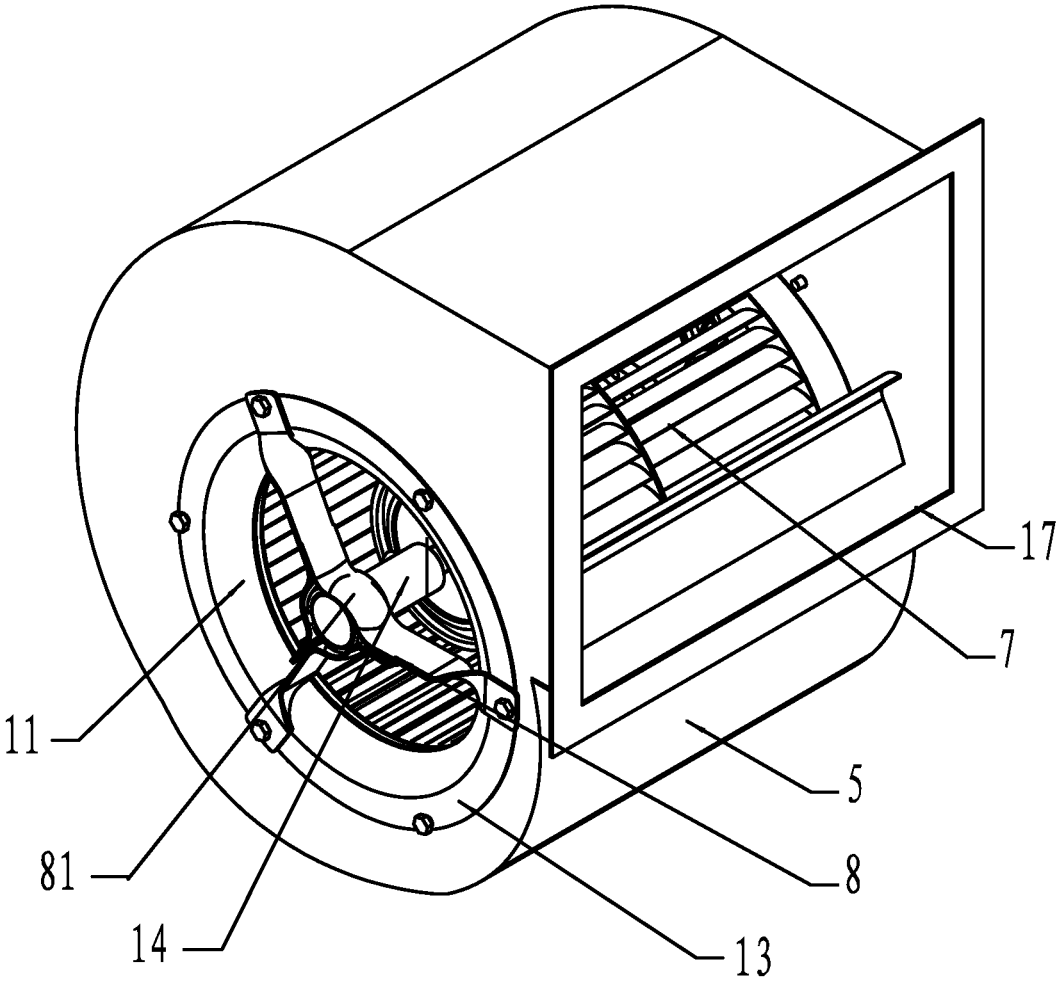
FIG. 4 is a solid diagram of a centrifugal blower of a heat exchanger for an indoor unit of an air conditioner of the invention.
Figure 5:
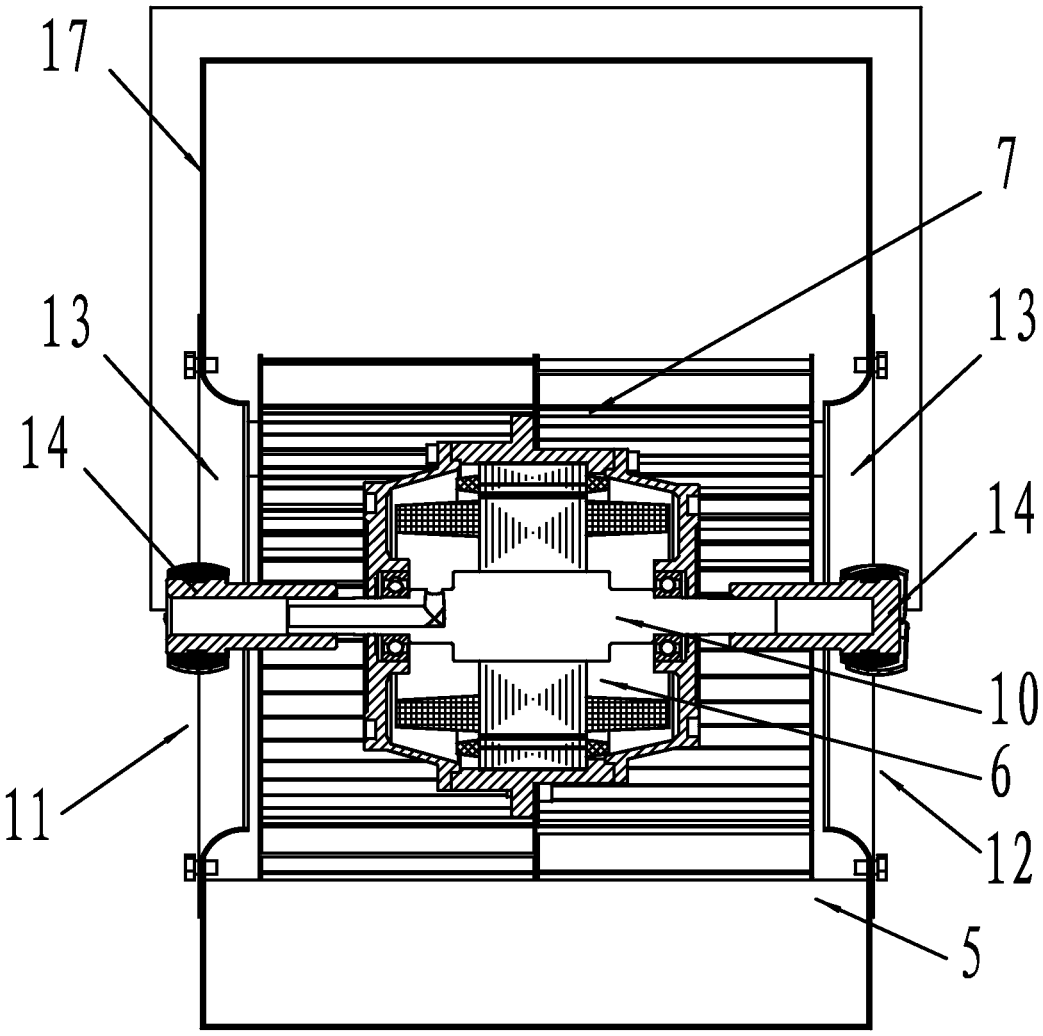
FIG. 5 is a schematic view of a centrifugal blower of a heat exchanger for an indoor unit of an air conditioner of the invention.

As shown in FIGS. 2, 3, 4 and 5, a heat exchanger for an indoor unit of an air conditioner of the invention comprises a housing having 1 an air inlet 15 and an air outlet 16, a cooling coil 3, and a centrifugal blower 4 having an air exit 17, a volute housing 5, a motor 6 and a centrifugal wind wheel 7.

The cooling coil 3 and the centrifugal blower 4 are disposed in the housing 1. The air inlet 15 and the air outlet 16 are disposed on both ends of the housing 1. The cooling coil 3 is disposed at the back of the air inlet 15. The centrifugal blower 4 is disposed at the back of the cooling coil 3. The air exit 17 of the centrifugal blower 4 is connected to the air outlet 16 of the housing 1.

The motor 6 is an external rotor motor and fit in the center of a cavity in the centrifugal wind wheel 7, and a left air intake 11 and a right air intake 12 are formed on both sides of the volute housing 5.

Figure 6:
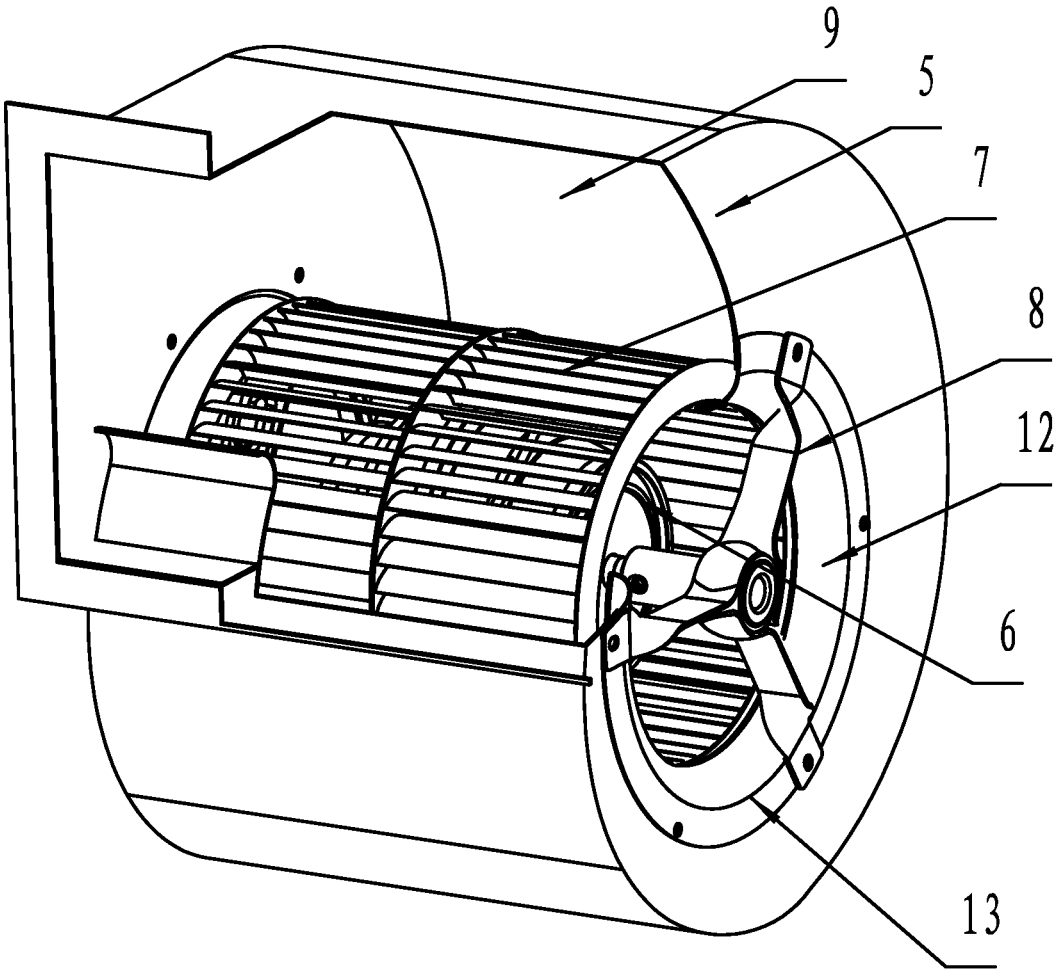
FIG. 6 is another schematic view of FIG. 4 from another angle.
Figure 7:
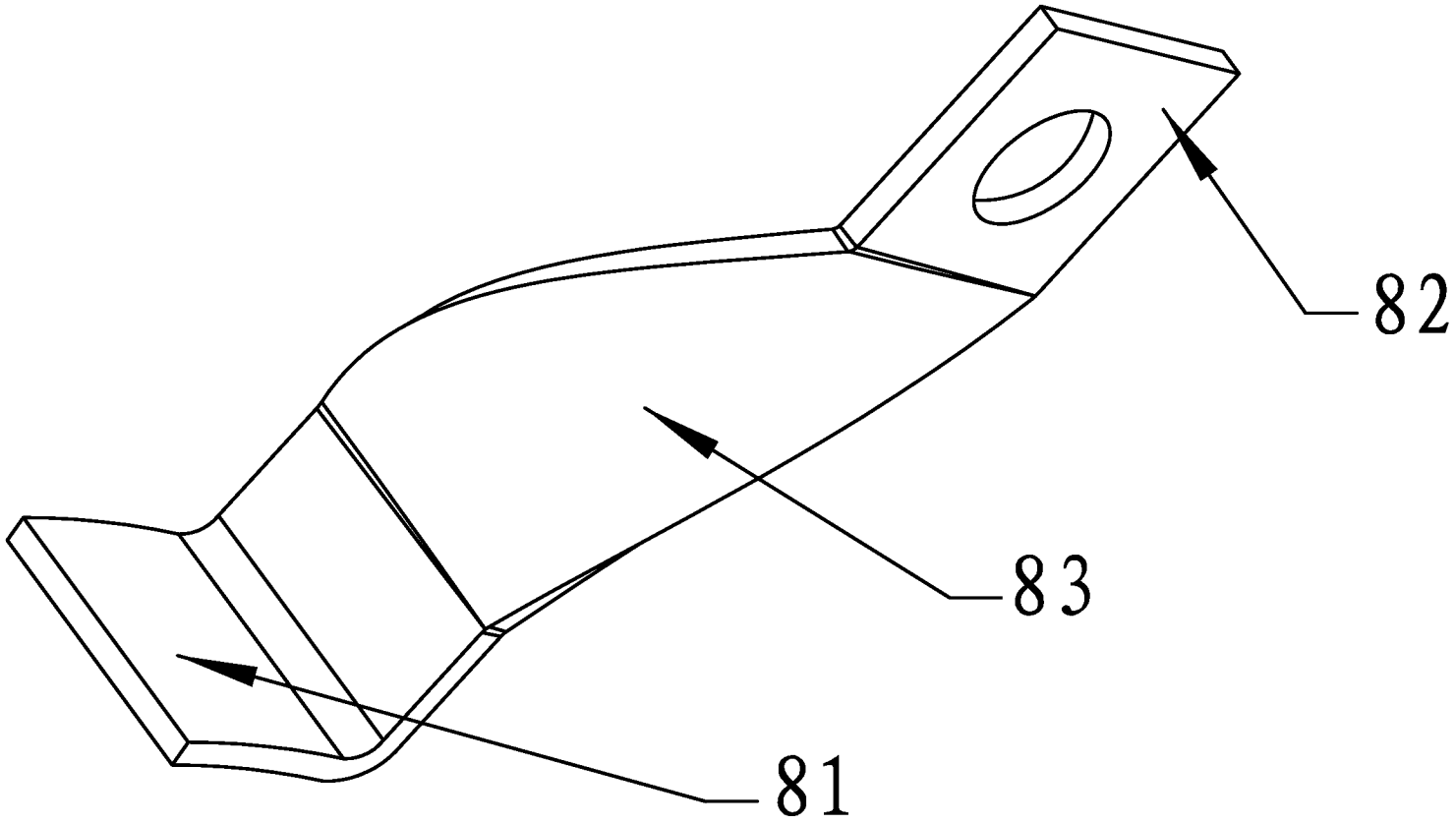
FIG. 7 is a schematic view of a bracket of the invention.

As shown in FIGS. 2-7, the motor 6 comprises a rotating shaft 10 and a bracket 8. Both ends of the rotating shaft 10 are disposed on the bracket 8, and the bracket 8 is disposed at the left air intake 11 and the right air intake 12 of the volute housing 5.

A flange 13 is disposed at the left air intake 11 and the right air intake 12, and on the volute housing 5. One end of the bracket 8 is connected to the flange 13, and the other end thereof is connected to an end of the rotating shaft 10 of the motor 6 whereby hanging the motor 6 and the centrifugal wind wheel 7 in a cavity 9 of the volute housing 5.

The bracket 8 comprises a connecting part 81, a receiving part 82, and a supporting part 83, and the supporting part 83 operates to connect the connecting part 81 to the receiving part 82.

A shaft sleeve 14 is disposed on outer wall of the end of the rotating shaft 10, and the connecting part 81 is directly welded on the shaft sleeve 14.

The flange 13, the receiving part 82 of the bracket 8, and the volute housing 5 are fit with each other via bolts.

The supporting part 83 of the bracket 8 is in the shape of a distorted sheet.

An air filter 2 is disposed at the air inlet 15.

The cooling coil 3 is V-shaped.

The motor 6 and the centrifugal wind wheel 7 are hang in the volute housing 5 via the bracket 8, and thus the left air intake 11 and the right air intake 12 are not blocked, and overall wind resistance is small; the centrifugal wind wheel 7 inhales airflow from the left air intake and the right air intake simultaneously, which ensures fluent and balanced air-intake from both sides thereof, increased air input and air output, small probability of resonance, and high blowing efficiency of the heat exchanger for the indoor unit of the air conditioner.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A heat exchanger for an indoor unit of an air conditioner, the heat exchanger comprising:

a housing having an air inlet, an air outlet, a left surface, and a right surface, said left surface and said right surface surrounding said air inlet;

a cooling coil; and a centrifugal blower having an air exit, a volute housing, a motor, and a centrifugal wind wheel;

wherein:

said cooling coil and said centrifugal blower are disposed in said housing;

said air inlet and said air outlet are separately disposed on two opposite ends of said housing;

said cooling coil is disposed in the back of said air inlet;

said centrifugal blower is disposed in the back of said cooling coil;

said air exit is connected to said air outlet;

said motor is an external rotor motor and fits in the center of a cavity in said centrifugal wind wheel;

a left air intake and a right air intake are respectively formed on two sides of said volute housing;

said motor comprises a rotating shaft having two ends, and two brackets;

two flanges are respectively disposed at said left air intake and said right air intake;

a shaft sleeve having an end surface is disposed on an outer wall of each of said two ends of said rotating shaft;

said connecting part is directly welded on said shaft sleeve;

each of said two flanges comprises an end surface;

said end surface of said shaft sleeve is disposed outside said volute housing and adjacent to said end surface of said each of said two flanges;

each of said two ends of said rotating shaft comprises an end surface;

said two end surfaces of said two ends of said rotating shaft are disposed inside said volute housing and adjacent to said two end surfaces of said two flanges, respectively;

each of said two brackets comprises a connecting part, a supporting part, and a receiving part;

said connecting part comprises a first end and a second end;

said supporting part comprises a third end and a fourth end;

said receiving part comprises a fifth end and a sixth end;

said sixth end is connected to one of said two flanges and said first end is connected to one of said two ends of said rotating shaft, wherein said motor and said centrifugal wind wheel are suspended in a cavity of said volute housing;

said second end is connected to said third end and an outer surface of said second end is in parallel to an outer surface of said third end;

said fourth end is connected to said fifth end and an outer surface of said fourth end is in parallel to an outer surface of said receiving part;

said supporting part is in a twisted shape and has a twist angle of substantially 90°;

an outer surface of said third end is substantially perpendicular to an outer surface of said fourth end;

an outer surface of said connecting part is substantially perpendicular to an outer surface of said receiving part;

said cooling coil comprises two planar surfaces which form a V-shaped configuration;

each of said two planar surfaces comprises a head edge and a root edge disposed opposite to said head edge;

head edges of said two planar surfaces are connected to each other and root edges of said two planar surfaces are separate from each other;

said root edges are connected separately to said left surface and said right surface;

said left surface and said right surface are boundaries of said air inlet; and said head edges are disposed in the back of said root edges.

2. The heat exchanger of claim 1, wherein said two flanges, said receiving part of said two brackets, and said volute housing are fit with each other via bolts.

3. The heat exchanger of claim 1, wherein an air filter is disposed at said air inlet.

4. In a heat exchanger for an indoor unit of an air conditioner, the heat exchanger comprising: a housing having an air inlet, an air outlet, a left surface, and a right surface, said air inlet and said air outlet being separately disposed on two opposite ends of said housing, and said left surface and said right surface circumscribing said air inlet; a cooling coil; and a centrifugal blower having an air exit, a volute housing, a motor, and a centrifugal wind wheel; a left air intake and a right air intake being respectively formed on two sides of said volute housing; said cooling coil and said centrifugal blower being disposed within said housing; said cooling coil being disposed in the back of said air inlet; said centrifugal blower being disposed in the back of said cooling coil; said cooling coil comprising two planar surfaces which form a V-shaped configuration; each of said two planar surfaces comprising a head edge and a root edge disposed opposite to said head edge; head edges of said two planar surfaces being connected to each other and root edges of said two planar surfaces being separate from each other;

wherein:

said motor is an external rotor motor and fits in the center of a cavity in said centrifugal wind wheel;

said motor comprises a rotating shaft having two ends, and two brackets;

two flanges are respectively disposed at said left air intake and said right air intake;

a shaft sleeve having an end surface is disposed on an outer wall of each of said two ends of said rotating shaft;

said connecting part is directly welded on said shaft sleeve;

each of said two flanges comprises an end surface;

said end surface of said shaft sleeve is disposed outside said volute housing and adjacent to said end surface of said each of said two flanges;

each of said two ends of said rotating shaft comprises an end surface;

said two end surfaces of said two ends of said rotating shaft are disposed inside said volute housing and adjacent to said two end surfaces of said two flanges, respectively;

each of said two brackets comprises a connecting part, a supporting part, and a receiving part;

said connecting part comprises a first end and a second end;

said supporting part comprises a third end and a fourth end;

said receiving part comprises a fifth end and a sixth end;

said sixth end is connected to one of said two flanges and said first end is connected to one of said two ends of said rotating shaft, wherein said motor and said centrifugal wind wheel are suspended in a cavity of said volute housing;

said second end is connected to said third end and an outer surface of said second end is in parallel to an outer surface of said third end;

said fourth end is connected to said fifth end and an outer surface of said fourth end is in parallel to an outer surface of said receiving part;

said supporting part is in a twisted shape and has a twist angle of substantially 90°;

an outer surface of said third end is substantially perpendicular to an outer surface of said fourth end;

an outer surface of said connecting part is substantially perpendicular to an outer surface of said receiving part;

said root edges are connected separately to said left surface and said right surface;

said left surface and said right surface are boundaries of said air inlet; and said head edges are disposed in the back of said root edges.

* * * * *